US006405687B1

(12) United States Patent
Arakawa et al.

(10) Patent No.: US 6,405,687 B1
(45) Date of Patent: Jun. 18, 2002

(54) CONTROL SYSTEM FOR TWO CYCLE INTERNAL COMBUSTION ENGINE

(75) Inventors: Yoshinobu Arakawa; Kouji Sasaki; Yoshikazu Tsukada, all of Numazu (JP)

(73) Assignee: Kokusan Denki Co. Ltd., Shizuoka-ken (JP)

( * ) Notice: Subject to any disclaimer, the term of this patent is extended or adjusted under 35 U.S.C. 154(b) by 0 days.

(21) Appl. No.: 09/631,811

(22) Filed: Aug. 3, 2000

(30) Foreign Application Priority Data

Aug. 6, 1999 (JP) ..... 11-224105

(51) Int. Cl.[7] ..... F01L 13/02
(52) U.S. Cl. ..... 123/41 E
(58) Field of Search ..... 123/41 E, 41 R, 123/406.58, 406.59

(56) References Cited

U.S. PATENT DOCUMENTS 4,208,992 A * 6/1980 Polo ..... 123/406.59
4,245,601 A * 1/1981 Crowder ..... 12/406.59
4,384,561 A * 5/1983 Komurasaki et al. .. 123/406.59
4,483,293 A * 11/1984 Akasu ..... 123/406.58
4,966,115 A * 10/1990 Ito et al. ..... 123/406.59
5,782,210 A * 7/1998 Venturoli et al. ..... 123/41 E
5,794,574 A * 8/1998 Bostelmann et al. ..... 123/41 E
5,964,191 A * 10/1999 Hata ..... 123/41 E
5,996,555 A * 12/1999 Lafontaine ..... 123/406.58
6,208,131 B1 * 3/2001 Cebis et al. ..... 123/406.58
6,234,119 B1 * 5/2001 Tsukada et al. ..... 123/41 E
6,237,546 B1 * 5/2001 Gander ..... 123/41 E

* cited by examiner

*Primary Examiner*—Willis R. Wolfe
*Assistant Examiner*—Jason Benton
(74) *Attorney, Agent, or Firm*—Pearne & Gordon LLP

(57) ABSTRACT

A control system for a two cycle internal combustion engine comprising signal generator means to generate a low speed ignition position detection signal at a position suitable for igniting the engine at a low speed of the engine so that an ignition system of the internal combustion engine is operated during a transient period after the engine is ignited at an overadvanced position until the rotational direction of the engine is confirmed whereby the engine is prevented from being stalled during the transient period.

2 Claims, 5 Drawing Sheets

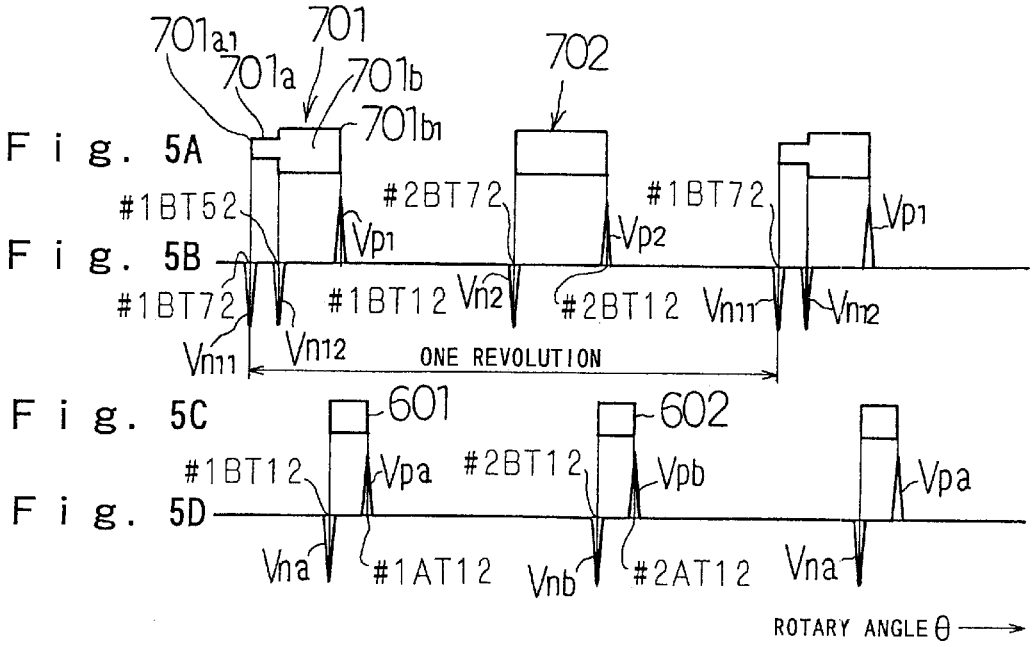
Fig. 5A
Fig. 5B
Fig. 5C
Fig. 5D
701a1
701
701a
701b
701b1
702
#1BT52
#2BT72
#1BT72
Vp1
Vp2
#1BT72
#1BT12
Vn2
#2BT12
Vn11
Vn12
Vn11
Vn12
ONE REVOLUTION
601
602
#1BT12
Vpa
#2BT12
Vpb
Vpa
Vna
#1AT12
Vnb
#2AT12
Vna
ROTARY ANGLE θ
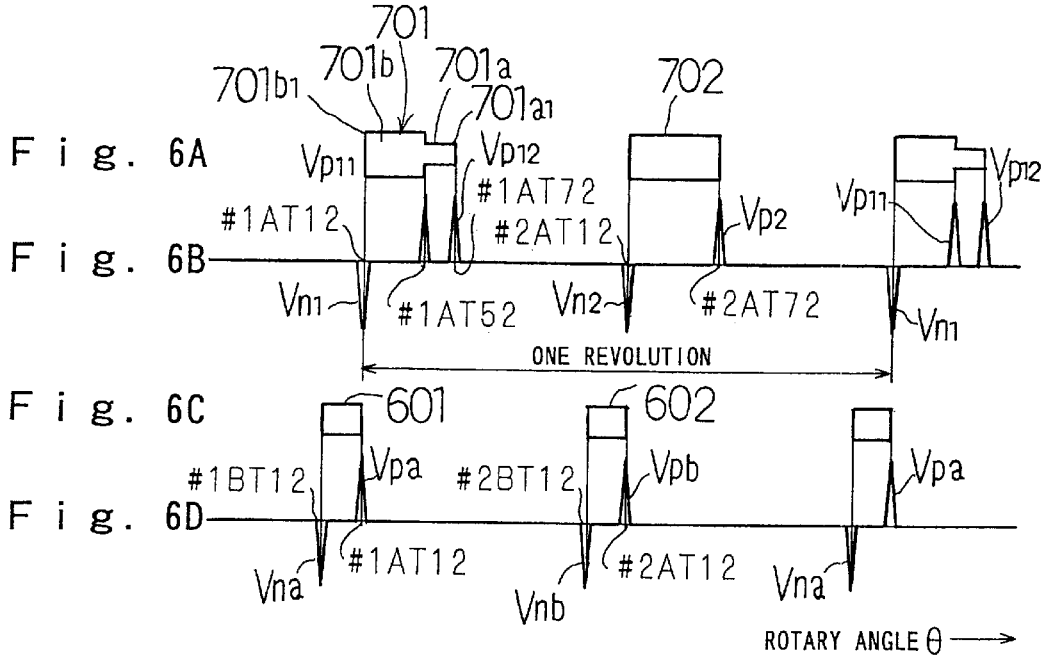
Fig. 6A
Fig. 6B
Fig. 6C
Fig. 6D
701
701b1
701b
701a
701a1
702
Vp11
Vp12
#1AT72
#1AT12
#2AT12
Vp2
Vp11
Vp12
Vn1
#1AT52
Vn2
#2AT72
Vn1
ONE REVOLUTION
601
602
#1BT12
Vpa
#2BT12
Vpb
Vpa
Vna
#1AT12
Vnb
#2AT12
Vna
ROTARY ANGLE θ

CONTROL SYSTEM FOR TWO CYCLE INTERNAL COMBUSTION ENGINE

TECHNICAL FIELD OF THE INVENTION

This invention pertains to a control system for a two cycle internal combustion engine adapted to control a rotational direction of the engine in a reverse direction.

BACKGROUND OF THE INVENTION

There have been used many two cycle gasoline engine (referred to as a two cycle internal combustion engine later) which can easily start by wire-recoiling, kicking or the like and can be provided in an small-sized and inexpensive manner as a primer for a traveling machine such as a scooter or a snowmobile which is required to be easily operated.

Since such a traveling machine comprises a transmission having no backup gear provided therein, the entire machine has been brought up and turned so that a front side thereof is directed in a back side in order to reverse a travelling direction thereof when it should be reversed in a narrow place etc., which causes the traveling machine to have a poor operation ability.

Of late, it has been considered that the traveling machine is adapted to have a backward traveling function by switching the two cycle internal combustion engine from the forward direction to the reverse direction in view of the characteristic of the two cycle internal combustion engine being able to normally operated in either of the forward and reverse directions.

It is required for driving the traveling machine in a forward or backward direction to arbitrarily switch the rotational direction of the two cycle internal combustion engine in accordance with a driver's instruction.

Such control devices as control to switch the rotational direction of the internal combustion engine are disclosed in U.S. Pat. No. 3,036,802, JP11-93719, JP11-82270 and JP9-252378.

These control devices serve to fully lower the revolution of the internal combustion engine for restraining the inertia of the engine as much as possible when the reversion instruction is provided by the driver. When the revolution of the engine is fully lowered, the ignition of the engine is made at an overadvanced position (a position where the ignition position is further more advanced than the most advanced position suitable for the usual operation) whereby a piston of the engine is forced back so as to rotate the internal combustion engine in a reverse direction. When it is confirmed that the engine is rotated in the reverse direction, the engine is ignited at the ignition position suitable for maintaining the rotation of the engine in the reverse direction so that the engine is operated while the rotational direction of the engine is kept reversed.

Various methods have been proposed which lower the revolution of the engine when the reversion instruction is provided. In these methods, the engine fails to be ignited as disclosed in U.S. Pat. No. 3,036,802, an injection of fuel from an injector which supplies the fuel into the engine is stopped as disclosed in JP11-93719, the ignition position is gradually advanced as disclosed in JP11-82270 and the ignition position is gradually delayed as disclosed in JP9-252378.

These control devices is provided with induction type signal generator means comprising a rotor having reluctors mounted on a crank shaft of the engine and a pulser (signal generator) to detect the rotor type reluctors to generate a pulse signal. The information about the revolution of the engine and the rotary angle position of the crank shaft are read from the pulses generated by the signal generator means and the ignition position of the engine and the injection time of the fuel are controlled by using the information.

The control devices to control to rotate the engine in the reverse direction are adapted to ignite the engine at a position suitable for maintaining the rotation of the engine in the reverse direction after the rotational direction of the engine in the reverse direction which is accomplished by the igniting the engine at the overadvanced position is confirmed. Thus, it will be noted that the control devices are required to comprise means to detect the rotational direction of the engine.

The proposed control devices comprise signal generator means including reluctors of particular figure to detect the rotational direction of the engine. The rotational direction of the engine is detected from the phase relation of the pulses obtained by the signal generator means after the engine is ignited at the overadvanced position and thereafter the engine is ignited at the position suitable for rotating the engine in the detected rotational direction.

Since the revolution of the engine cannot be arithmetically operated in a precise manner when the engine starts and therefore the ignition position of the engine cannot be decided by the arithmetical operation, the signal generator means is so constructed as to generate pulses of positive polarity at a position slightly advanced relative to a top dead center of respective cylinders (a position of 12° before the top dead center, for example) when the engine rotates in the forward direction. An ignition timing signal is applied to an ignition system whenever the pulses of positive polarity are generated when the engine starts whereby the ignition of the respective cylinders are made.

When the ignition of the engine is made at the overadvanced position for reversing the rotational direction of the engine, the explosion power generated by the ignition is applied against the inertia of the engine which tries to maintain the present rotation of the engine and the engine is successfully rotated in the reverse direction when the explosion power overcomes the inertia. If the explosion power is defeated by the inertia, then the engine fails to be rotated in the reverse direction. If the explosion power is equal to the inertia, then the engine stops.

In any cases, since the engine is in the condition of being rotated by a slight difference between the explosion power and the inertia after the engine is ignited at the overadvanced position and before the rotational direction of the engine is confirmed, the engine tends to easily stop. In order to maintain the rotation of the engine in this condition, the engine desirably continues to be ignited. However, in the prior art control devices, since the engine cannot continue to be ignited during the period after the ignition of the engine is made at the overadvanced position and before the rotational direction of the engine is detected, the engine tends to be undesirably stalled during the period.

It is considered that the engine is ignited by applying to the ignition system the pulses generated by the signal generator means as the ignition timing signal during the transient period after the engine is ignited at the overadvanced position and before the rotational direction of the engine is detected. However, the pulses which can be used as the ignition timing signal when the engine rotates at low speed are only the ones of positive polarity among the pulses generated by the conventional signal generator means. Since the pulses generated by the signal generator means when the engine rotates in the reverse direction is generated at the position not suitable for any ignition position, the pulses generated by the signal generator means during the transient period after the engine is ignited at the overadvanced position and until the reversion of the engine is confirmed cannot be used as the ignition timing signal.

SUMMARY OF THE INVENTION

Accordingly, it is a principal object of the invention to provide a control system for a two cycle internal combustion engine so constructed for the engine to never fail to stall during the period after the engine is ignited at the overadvanced position for operating the engine in the reverse direction until it is confirmed that the rotational direction of the engine is reversed.

The present invention relates to a control system for a two cycle internal combustion engine comprising reversion instruction generator means to generate a reversion instruction to instruct a rotational direction of the internal combustion engine to be reversed and a control unit to control the internal combustion engine so as to accomplish a speed reduction step of reducing a revolution of the internal combustion engine when the reversion instruction is generated and an overadvanced ignition step of igniting the internal combustion engine at an overadvanced position for reversing the rotational direction of the internal combustion engine when the revolution of the internal combustion engine is reduced to an overadvance starting revolution by the speed reduction step.

In the present invention, the control system further comprises signal generator means to generate low speed ignition position detection pulses at a position suitable for a low speed ignition position in a condition where the internal combustion engine rotates in a forward direction when it rotates in the forward direction and to generate low speed ignition position detection pulses at a position suitable for a low speed ignition position in a condition where the internal combustion engine rotates in a reverse direction when it rotates in the reverse direction.

Furthermore, the control unit includes transient period ignition control means to ignite the internal combustion engine at a position where the signal generator means generates the low speed ignition position detection pulses after the overadvanced ignition step is performed.

With the control system constructed as aforementioned, the internal combustion engine can be ignited at the position suitable for the low speed ignition position even though the rotational direction of the engine succeeds or fails to be reversed in the transient condition after the engine is ignited at the overadvanced position. It will be noted that this prevents the engine from failing to stall after the engine is ignited at the overadvanced position in order to reverse the rotational direction of the engine.

In case that the internal combustion engine has n (n is an integral number of 1 or more than) cylinders, the signal generator means includes a rotor mounted on a crank shaft of the engine and having n reluctors provided so as to correspond to the respective cylinders in the engine with a thickness and a width of the reluctors uniform in a rotational direction of the crank shaft of the engine and pulsers disposed at positions where the reluctors of the rotor can be detected to generate low speed ignition position detection pulses for the respective cylinders when front edges of the reluctors corresponding to the respective cylinders as viewed in the rotational direction are detected.

The reluctors corresponds to the respective cylinders being provided so that both peripheral ends of the reluctors are positioned in both sides of a linear line bonding a center of the crank shaft and a center of a magnetic pole of the corresponding pulser when a piston of the respective cylinders of the internal combustion engine reaches the top dead center and the both peripheral ends of the reluctors are so set that the pulser generates the low speed ignition position detection pulses at a position suitable for an ignition position for the cylinders in the internal combustion engine even though the engine rotates in either of rotational directions.

The control unit includes transient period ignition control means which is so constructed as to ignite the internal combustion engine when the signal generator means detects the front edge of the reluctor corresponding to each one of the cylinders to generate the low speed ignition position detection pulses after the overadvanced ignition step is performed.

In practically making the control system, there is required to be provided means to obtain an information used for deciding the rotational direction of the internal combustion engine. In case that the engine is a multi-cylinder engine having 2 or more than cylinders, there is required to be provided means to obtain a rotary angle information used for deciding which of the cylinders should be ignited or to which of the cylinders the fuel should be injected.

In order to obtain the information on the rotational direction of the engine and on the decision of the cylinder, there may be provided signal generator means separate from the one for obtaining the signal determining the low speed ignition position, but single signal generator means may be preferably provided to obtain all the informations on the rotation of the engine, which causes the construction to be simplified.

To this end, the signal generator means preferably comprises a rotor mounted on the crank shaft of the engine and having first and second inductor magnetic pole portions provided so as to be offset from each other in an axial direction of the crank shaft of the internal combustion engine and first and second pulseres provided corresponding to the first and second inductor magnetic pole portions, respectively.

The first inductor magnetic pole portion has n first reluctors formed with a thickness and a width uniform in the rotational direction of the crank shaft and disposed at an equal angular distance corresponding to the n (n is an integral number of 2 or more than) cylinders in the engine while the second inductor magnetic pole portion has n second reluctor including one two step reluctor portion of first and second portions arranged in the rotational direction of the crank shaft and formed so that a boundary of the first and second portions changes in their thickness and width and (n−+b 1) one step reluctor portions formed so as to have a thickness and a width uniform in the rotational direction of the crank shaft. In this case, the second reluctors are disposed at an equal angular distance with the two step reluctor portion corresponding to one of the cylinders of the internal combustion engine and with the (n−+b 1) one step reluctor portions corresponding to the cylinders other than the one of the cylinders.

The first pulser is so constructed as to be disposed so as to be able to detect each of the reluctors of the first inductor magnetic pole portions of the rotor to generate pulses of different polarities when both of the peripheral ends of the reluctors of the first inductor magnetic pole portion detected. The second pulser is so constructed as to be disposed so as to be able to detect the two step reluctor and the one step reluctors of the second inductor magnetic pole portion of the rotor to generate a pair of pulses of the same polarity, respectively when the end of the two step reluctor in the side of the first portion and the boundary are detected, respectively, a single pulse of polarity different from the polarity of the pair of pulses when the end of the two step reluctor in the side of the second portion is detected and pulses of different polarities, respectively when the both ends of the one step reluctor are detected.

The first reluctors corresponding to the respective cylinders are so set that the first pulsers generate pulses at a position suitable for a low speed ignition position for the cylinder in the internal combustion engine when the first pulsers detect the front edges of the first reluctors corresponding to the respective cylinders in the rotational direction even though the engine rotates in either of rotational directions.

The control unit comprises transient period ignition control means to ignite the internal combustion engine when the front edges of the first reluctors in the rotational direction are detected after the overadvanced ignition step is performed, rotational direction detection means to detect the rotational direction of the internal combustion engine on a phase relation between the pair of pulses and the single pulse generated by the second pulser, revolution arithmetical operation means to arithmetically operate a revolution of the internal combustion engine on a generation distance of the pulses generated by the first pulser or on a generation distance of the pulses generated by the second pulser, ignition position arithmetical operation means to arithmetically operate an ignition position of the internal combustion engine at the revolution arithmetically operated by the revolution arithmetical operation means, cylinder judgment means to judge which of the cylinders should be ignited on a phase relation between the pair of pulses and the single pulse generated by the second pulser and ignition position control means to control the cylinder judged by the cylinder judgement means to be ignited at the ignition position arithmetically operated by the ignition position arithmetical operation means so as to maintain the rotation of the internal combustion engine in the rotational direction detected by the rotational direction detection means.

With the signal generator means constructed as aforementioned, the rotational direction of the engine can be judged by determining the phase relation between the pair of pulses of the same polarity generated when the second pulser detects the two step reluctor and the single pulse of polarity different from that of the pair of the pulses. Since which of the cylinders corresponds to the reluctors detected to generate the pulses can be judged by detecting the generation order of the pulses of positive and negative polarities generated by the first and second pursers, the informations on the judgment of the cylinders to be ignited and the judgment of the cylinders to which the fuel should be injected can be more easily obtained.

BRIEF DESCRIPTION OF THE DRAWING

The above and other objects and features of the invention will be apparent from the description of the embodiments of the invention taken along with reference to the accompanying drawings in which;

FIG. 5A illustrates configurations of second reluctors corresponding to a second pulser of the signal generator means of FIG. 3 at respective rotary angle positions of the engine when the engine rotates in a forward direction;

FIG. 5B shows waveforms of pulses generated by the second pulser detecting the edges of the second reluctors of FIG. 5A in the engine rotates in the forward direction;

FIG. 5C illustrates configurations of first reluctors corresponding to the first pulser of the signal generator means at respective rotary angle positions of the engine when the engine rotates in the forward direction;

FIG. 5D shows waveforms of pulses generated by the first pulser detecting the edges of the first reluctors of FIG. 5C in the engine rotates in the forward direction;

FIG. 6A illustrates configurations of the second reluctors corresponding to the second pulser of the signal generator means at respective rotary angle positions of the engine when the engine rotates in a reverse direction;

FIG. 6B shows waveforms of pulses generated by the second pulser detecting the edges of the second reluctors of FIG. 6A in the engine rotates in the reverse direction;

FIG. 6C illustrates configurations of the first reluctors corresponding to the first pulser of the signal generator means at respective rotary angle positions of the engine when the engine rotates in the reverse direction;

FIG. 6D shows waveforms of pulses generated by the first pulser detecting the edges of the first reluctors of FIG. 6C in the engine rotates in the reverse direction;

DETAILED DESCRIPTION OF EMBODIMENTS OF THE INVENTION

Figure 1:
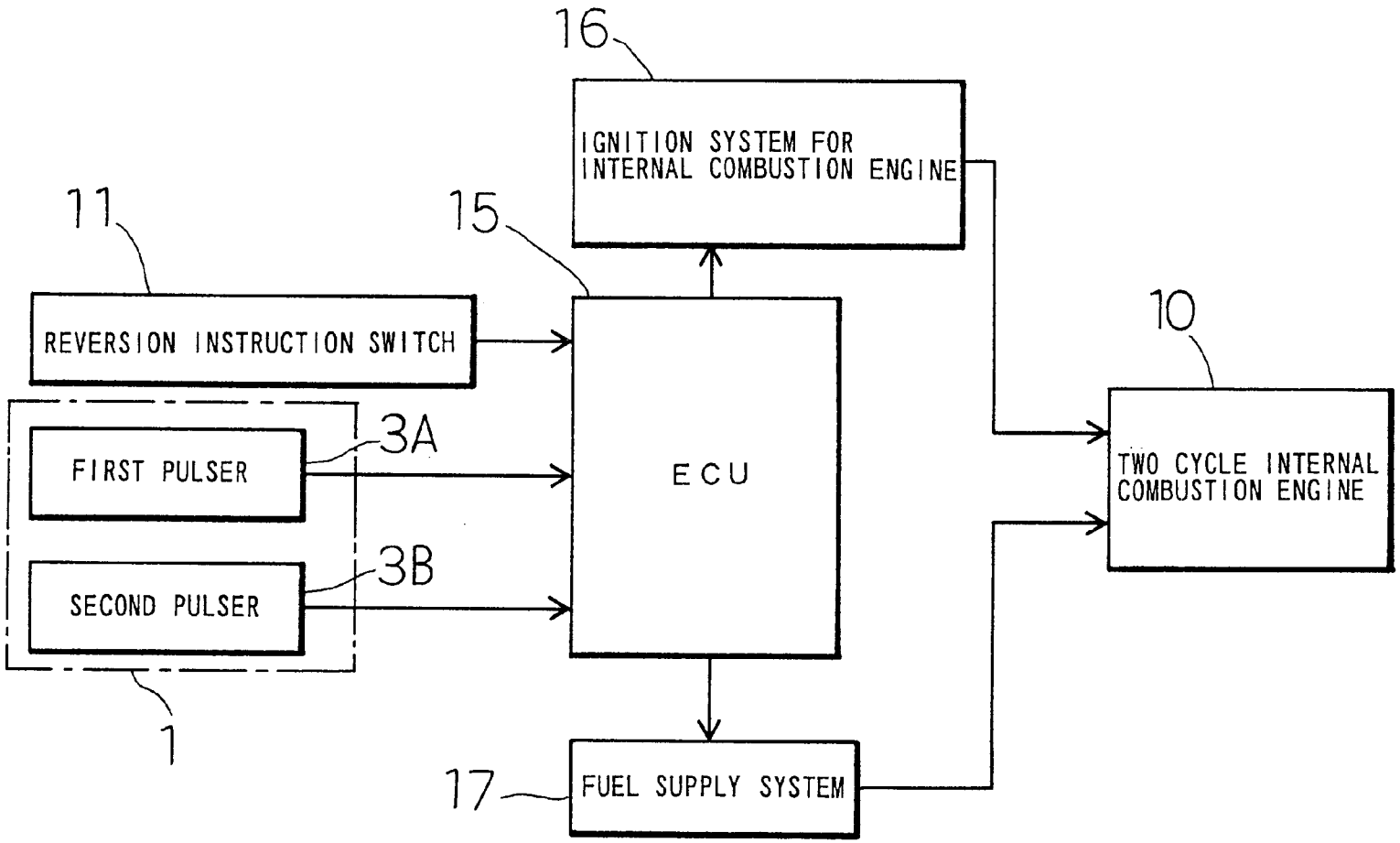
FIG. 1 is a schematic block diagram in which a control system constructed in accordance with the present invention is briefly shown.

Now referring to FIG. 1, there is briefly shown a control system to control a two cycle internal combustion engine 10 constructed in accordance with one embodiment of the invention. The control system comprises a reversion instruction switch 11 operated when a traveling machine should be driven in a reverse direction. In the embodiment, reversion instruction generation means may be formed of the reversion instruction switch 11.

The reversion instruction switch 11 may be either of a change-over switch having a plurality of stationary contacts and a movable contact to be engaged with the selected ones of the stationary contacts or a momentary switch such as a push-button switch which is in an on-condition or off-condition while an operative force is applied to the button.

With the change-over switch used as the reversion instruction switch, the reversion instruction may be generated by engaging the movable contact with either of the stationary contacts in accordance with the forward movement or the reverse movement of the traveling machine.

With the momentary switch used as the reversion instruction switch, the reversion instruction to make the traveling direction reverse is generated whenever the switch is operated.

The signal generator means 1 of FIG. 1 comprises a first pulser 3A and a second pulser 3B, both of which generate a pulse signal including an information on the rotation of the engine in synchronization with rotation of a crank shaft of the engine.

An electronic control unit (ECU) 15 inputs the reversion instruction applied by the reversion instruction switch 11 and the pulses generated by the first and second pulsers 3A and 3B to control an ignition system 16 and a fuel supply system 17 for the internal combustion engine. The fuel supply system 17 comprises injectors not shown provided for respective cylinders and a drive circuit to apply a drive current to the respective injectors.

Although not shown, an output of a throttle sensor to detect an opening degree of a throttle valve, an output of a temperature sensor to detect a temperature of cooling water in the engine, an output of a sensor to detect an intake temperature, an output of a sensor to detect an atmospheric pressure and so on are input to the ECU 15. These outputs of the sensors are used for arithmetically operating an ignition position of the engine and a time for which a fuel is injected from the injectors (a fuel injection time).

Figure 3:
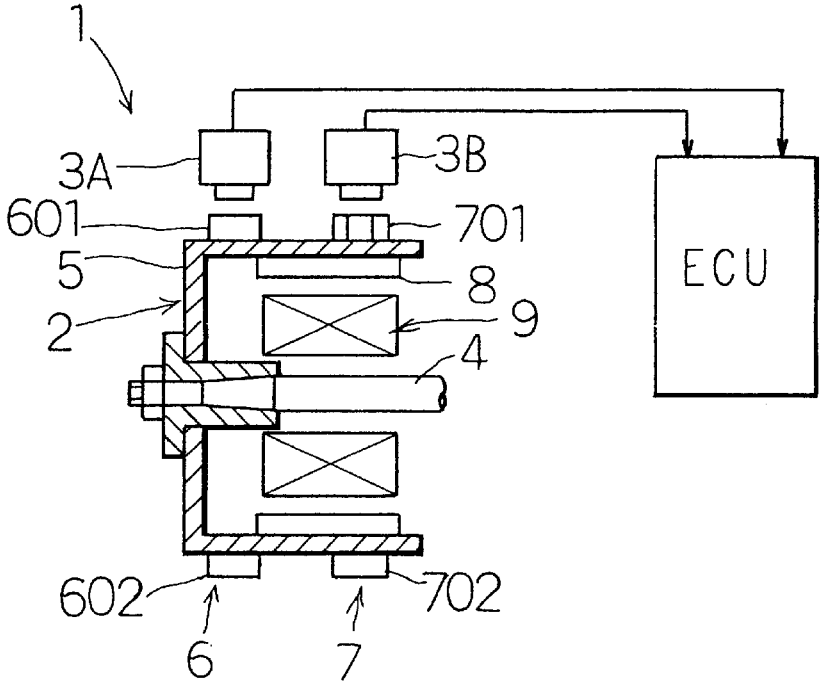
FIG. 3 is a block diagram of one embodiment of signal generator means used for the control system of FIG. 1.

The signal generator means 1 including the first and second pulsers 3A and 3B constructed in accordance with one embodiment of the invention is schematically illustrated in FIG. 3. The illustrated signal generator means 1 comprises a rotor 2 mounted on a crank shaft 4 of the internal combustion engine and the first and second pulsers 3A and 3B securely provided on an engine case or an engine cover.

The rotor 2 comprises a cup-shaped flywheel 5 mounted on an leading end of the crank shaft 4 of the internal combustion engine and first and second inductor magnetic pole portions 6 and 7 formed on an outer peripheral face of the flywheel 5 which are disposed so as to be offset from each other in an axial direction of the flywheel 5. The first and second pulsers 3A and 3B serve to detect the first and second inductor magnetic pole portions 6 and 7, respectively to output the pulse signals.

Figure 4A:
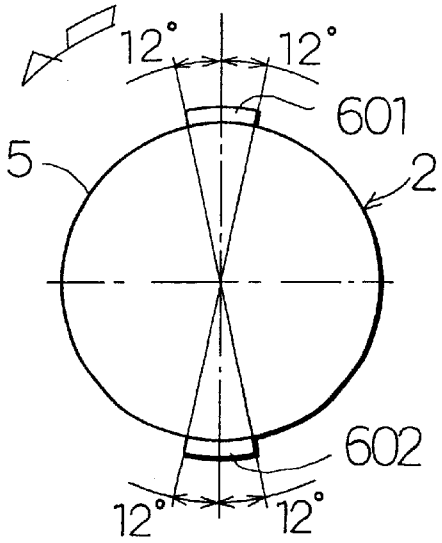
FIGS. 4A and 4B illustrate different embodiments of a first reluctor provided in a rotor of the signal generator means of FIG. 2.
Figure 7:
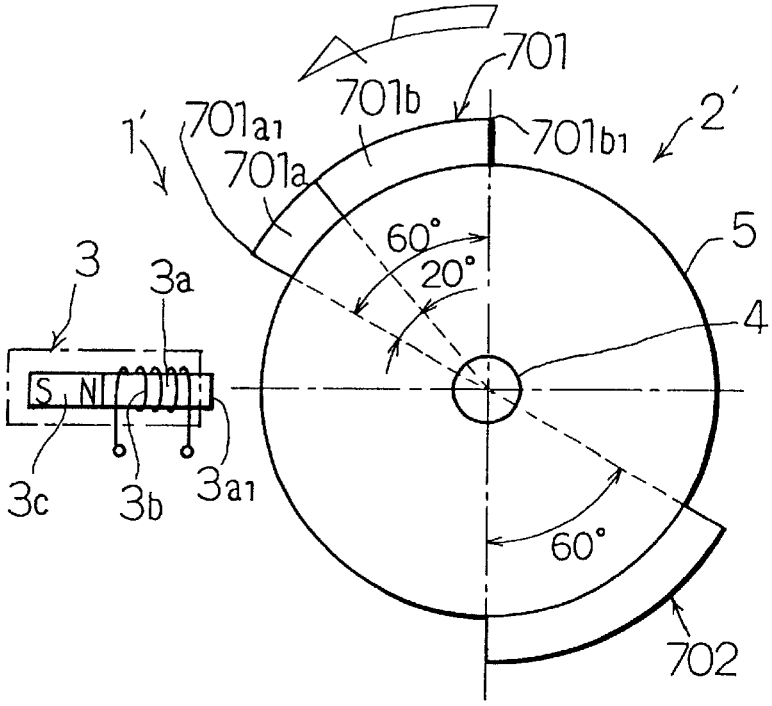
FIG. 7 illustrates the second reluctors and the second pulser used for the signal generator means of FIG. 3 constructed in accordance with one embodiment of the invention.

As shown in FIG. 4A, the first inductor magnetic pole portion 6 comprises a pair of first reluctors 601 and 602 disposed at a 180° distance from each other and as shown in FIG. 7, the second inductor magnetic pole portion 7 comprises a pair of second reluctors 701 and 702 disposed at a 180° distance from each other in the same manner.

The first reluctors 601 and 602 comprise an arc-like protrusion formed on the outer peripheral face of the flywheel 5 so that the peripheral direction of the reluctors corresponds to that of the flywheel. The first reluctors 601 and 602 are of a one step reluctor which has a width and a thickness uniform along the peripheral direction of the flywheel and a peripheral length set to be equal to each other. In the illustrated embodiment, the first reluctors 601 and 602 have a polar arc angle set to be 24°.

As shown in FIGS. 5A, 6A, 7 and 8A, the reluctor 701 among the second reluctors 701 and 702 comprises a two step reluctor having a first narrow portion 701*a* and a second wide portion 701*b* arranged in the peripheral direction of the flywheel while the other reluctor 702 comprises a one step reluctor having a width uniform along the peripheral direction of the flywheel 5. In the illustrated embodiment, the polar arc angles of the first and second portions 701*a* and 701*b* of the two step reluctor 701 are set at 20° and 40°, respectively and therefore the polar arc angle of the whole two step reluctor is set at 60°.

As shown in FIGS. 5A, 6A, 7 and 8B, the one step reluctor 702 has a width and a thickness uniform along the rotational direction of the crank shaft and a polar arc angle set at 60°.

It will be noted that the two step reluctor 701 corresponds to the first cylinder of the internal combustion engine while the one step reluctor 702 corresponds to the second cylinder of the engine.

In the illustrated embodiment, the reluctor 601 is so provided that both ends of the reluctor 601 in the peripheral direction thereof are located at a position symmetrical to a linear line A—A bonding a center of the crank shaft and a center of the first pulser 3A on both sides thereof when a piston of the first cylinder of the internal combustion engine reaches a top dead center and the reluctor 602 is so provided that both ends of the reluctor 602 in the peripheral direction thereof are positioned at a position symmetrical to a linear line A—A bonding the center of the crank shaft and the center of the first pulser 3A on both sides thereof when a piston of the second cylinder of the internal combustion engine reaches a top dead center.

The first and second pulsers 3A and 3B are constructed in the same manner and the first pulser 3A generates the pulses of different polarities when it detects the edges of both ends of the first reluctor 601 and 602.

The second pulser 3B generates the pulse signal of the same polarity when it detects the end 701*a*1 of the first portion 701*a* of the second reluctor 701 and when it detects the boundary of the first and second portions 701*a* and 701*b* and the pulse signal of different polarities when it detects the end 701*b*1 of the second portion 701*b*. Also, the second pulser 3*b* generates the pulse signal of different polarities when it detects both ends of the second reluctor 702, respectively.

The second pulser 3B constructed in accordance with one embodiment of the invention is illustrated in FIG. 7. The illustrated pulser 3B may be of conventional one which comprises an iron core 3*a* having a magnetic pole portion 3*a*1 provided at a leading end thereof and faced to the reluctor, a signal coil 3*b* wound on the iron core 3*a* and a permanent magnet 3*c* magnetically bonded to the iron core 3*a* with the magnetic pole portion 3*a*1 disposed so as to be faced to the reluctors 701 and 702 on the peripheral face of the rotor while a predetermined gap is provided therebetween. The pulser 3B may be mounted on a pulser mount provided on the engine case or the engine cover.

In the embodiment of FIG. 7, the rotor 2 is supposed to rotate in a counterclockwise direction as viewed in FIG. 7 as indicated by an arrow when the engine rotates in a forward direction. The first pulser 3A and the second pulser 3B may be also constructed in the same manner and mounted on the pulser mount provided on the engine case or the engine cover.

In FIGS. 5C and 5A are shown the first and second reluctors faced to the first and second pulsers 3A and 3B, respectively at the respective rotary angular positions of the engine when the engine rotates in the forward direction and in FIGS. 5D and 5B are shown the waveforms of the pulse signals generated by the first and second pulsers 3A and 3B detecting the edges of the first reluctors 601 and 602 and the second reluctors 701 and 702 when the engine rotates in the forward direction.

In FIGS. 6C and 6A are shown the first and second reluctors faced to the first and second pulsers 3A and 3B, respectively at the respective rotary angular positions of the engine when the engine rotates in the reverse direction and in FIGS. 6D and 6B are shown the waveforms of the pulse signals generated by the first and second pulsers 3A and 3B detecting the edges of the first reluctors 601 and 602 and the second reluctors 701 and 702 when the engine rotates in the reverse direction.

A code "BT" indicated in FIGS. 5 and 6 is an abbreviation of "Before Top Dead Center" and a number indicated following the code "BT" means an angle measured in the advanced side relative to the top dead center (a rotary angle position of the crank shaft when the piston reaches the top dead center) as a reference. Also, a code "AT" is an abbreviation of "After Top Dead Center" and a number indicated following the code "AT" means an angle measured in the delayed side relative to the top dead center as a reference. Furthermore, what "#1" and "#2" mean are rotary angle positions involving the first and second cylinders of the engine, respectively. For example, "#1BT52" means a position of 52° before the top dead center of the first cylinder and "#2AT12" means a position of 12° after the top dead center of the second cylinder.

In the aforementioned signal generator means, as shown in FIG. 5D, a position relation between the first reluctors 601 and 602 and the first pulser 3A is so set to generate the pulses Vna of negative polarity and the pulses Vpa of positive polarity by the first pulser 3A detecting the front end and the rear end of the one reluctor 601 of the first reluctor, respectively when the rotary angle position of the crank shaft corresponds to the position "#1BT12" which is advanced at the angle of 12° relative to the top dead center of the first cylinder (the rotary angle position of the crank shaft corresponding to the top dead center of the piston of the first cylinder) and to the position "#1AT12" which is delayed at the angle of 12° relative to the top dead center of the first cylinder, respectively when the engine rotates in the forward direction and to generate the pulses Vnb of negative polarity and the pulses Vpb of positive polarity by the first pulser 3A detecting the front end and the rear end of the other reluctor 602 of the first reluctor, respectively when the rotary angle position of the crank shaft corresponds to the position "#2BT12" which is advanced at the angle of 12° relative to the top dead center of the second cylinder and to the position "#2AT12" which is delayed at the angle of 12° relative to the top dead center of the second cylinder, respectively when the engine rotates in the forward direction.

The pulses Vna and Vnb of negative polarity (see FIG. 5D) generated at the position of 12° before the top dead center of the first cylinder and at the position of 12° before the top dead center of the second cylinder, respectively when the engine rotates in the forward direction are used as the low speed ignition position detection pulses for the first and second cylinders when the engine rotates in the forward direction while the pulses Vna and Vnb of negative polarity (see FIG. 6D) generated at the position of 12° before the top dead center of the first cylinder and at the position of 12° before the top dead center of the second cylinder, respectively when the engine rotates in the reverse direction are used as the low speed ignition position detection pulses for the first and second cylinders when the engine rotates in the reverse direction.

As shown in FIG. 5B, the sizes of the second reluctors 701 and 702 and the position relation between the second reluctors 701 and 702 and the second pulser 3B are so set to generate the pulses Vn11 and Vn12 of negative polarity by the second pulser 3B detecting the end 701*a*1 of the first portion 701*a* of the one reluctor 701 of the second reluctor and the boundary between the first and second portions 701*a* and 701*b*, respectively when the rotary angle position of the crank shaft corresponds to the position which is advanced at the angle of 72° relative to the top dead center of the first cylinder and to the position which is advanced at the angle of 52° relative to the top dead center of the first cylinder, respectively, when the engine rotates in the forward direction, to generate the pulse Vp1 of positive polarity from the second pulser 3B when the rotary angle position of the crank shaft corresponds to the position which is advanced at the angle of 12° relative to the top dead center of the first cylinder when the engine rotates in the forward direction and to generate the pulses Vn2 of negative polarity and the pulses Vp2 of positive polarity by the second pulser 3B detecting the front end and the rear end of the other reluctor 702 of the second reluctor, respectively when the rotary angle position of the crank shaft corresponds to the position which is advanced at the angle of 72° relative to the top dead center of the second cylinder and to the position "#2AT12" which is advanced at the angle of 12° relative to the top dead center of the second cylinder, respectively when the engine rotates in the forward direction.

In FIG. 5, the rotary angle positions "#1BT72" and "#2BT72" of the crank shaft which are advanced at the angle of 72° relative to the top dead center of the first and second cylinders are positions where the measurement of the ignition positions of the first and second cylinders and the measurement of the injection timing obtained by the arithmetical operation begin. The rotary angle position "#1BT52" of the crank shaft which is advanced at the angle of 52° relative to the top dead center of the first cylinder is an overadvanced position where the first cylinder is ignited when the revolution is reduced to the one where the overadvance begins for reversing the engine. In FIG. 5D, the rotary angle positions "#1BT12" and "#2BT12" of the crank shaft which are advanced at the angle of 12° relative to the top dead center of the first and second cylinders are positions suitable for igniting the respective cylinders. When the engine starts or rotates at low speed, the engine is ignited at these positions "#1BT12" and "#2BT12".

In FIG. 6, the rotary angle position "#1AT52" which is delayed at the angle of 52° relative to the top dead center of the first cylinder is a delayed position where the first cylinder is ignited when the revolution is reduced to the overadvanced revolution for reversing the rotational direction of the engine (for rotating the engine in the forward direction). In FIG. 6D, the rotary angle positions "#1BT12" and "#2BT12" of the crank shaft which are advanced at the angle of 12° relative to the top dead center of the first and second cylinders are the ignition positions where the engine is ignited for driving the engine with the engine maintained to rotate in the reverse direction.

With the signal generator means 1 constructed as aforementioned, the low speed ignition position detection pulses Vna and Vnb can be obtained from the first pulser 3A at the position (a position of 12° before the top dead center of the respective cylinders) suitable for the ignition position when the first and second cylinders are ignited at low speed in spite of the forward direction and the reverse direction of the internal combustion engine. Thus, with the engine ignited when the first pulser 3A generates the pulses Vna and Vnb in the transient condition after the engine is ignited at the overadvanced position for reversing the rotational direction of the engine and before the rotational direction of the engine is confirmed, the engine can be ignited at the position suitable for maintaining the rotation of the engine in spite of the success in the reversion of the rotational direction of the engine or the failure in the reversion of the engine, which prevents the engine from stalling.

The control unit 15 of the invention comprises transient period ignition control means to control the ignition operation of the cylinders by applying the ignition timing to the ignition system for igniting the internal combustion engine when the signal generator means 1 generates the low speed ignition position detection pulses for the respective cylinders. The fuel injection timing of the first and second cylinders are supposed to be identical to the aforementioned ignition timing.

Since there is required no high traveling speed when the traveling machine moves in the reverse or backward direction, the ignition system is not supposed to be controlled when the engine rotates in the reverse direction. Thus, the first and second cylinders are ignited when the first pulser 3A generates the low speed ignition position detection pulses Vna and Vnb, respectively.

In the embodiment of FIG. 3, a magnet field may be formed of a permanent magnet 8 mounted on the inner periphery of the peripheral wall of the flywheel 5 and a stator 9 may be formed of a generator coil wound on an iron core having magnetic pole portions faced to the magnetic poles of the magnet field. The stator 9 may be securely provided on a stator mount on the case of the internal combustion engine. A flywheel magnet rotor is formed of the flywheel 5 and the magnet 8. A magneto generator is formed of the magnet rotor and the stator 9. The magneto generator is used for supplying a drive voltage to the ignition system for the internal combustion engine and to the injector or for applying an electric power to an electric power source circuit of the electronic control unit 15.

Figure 2:
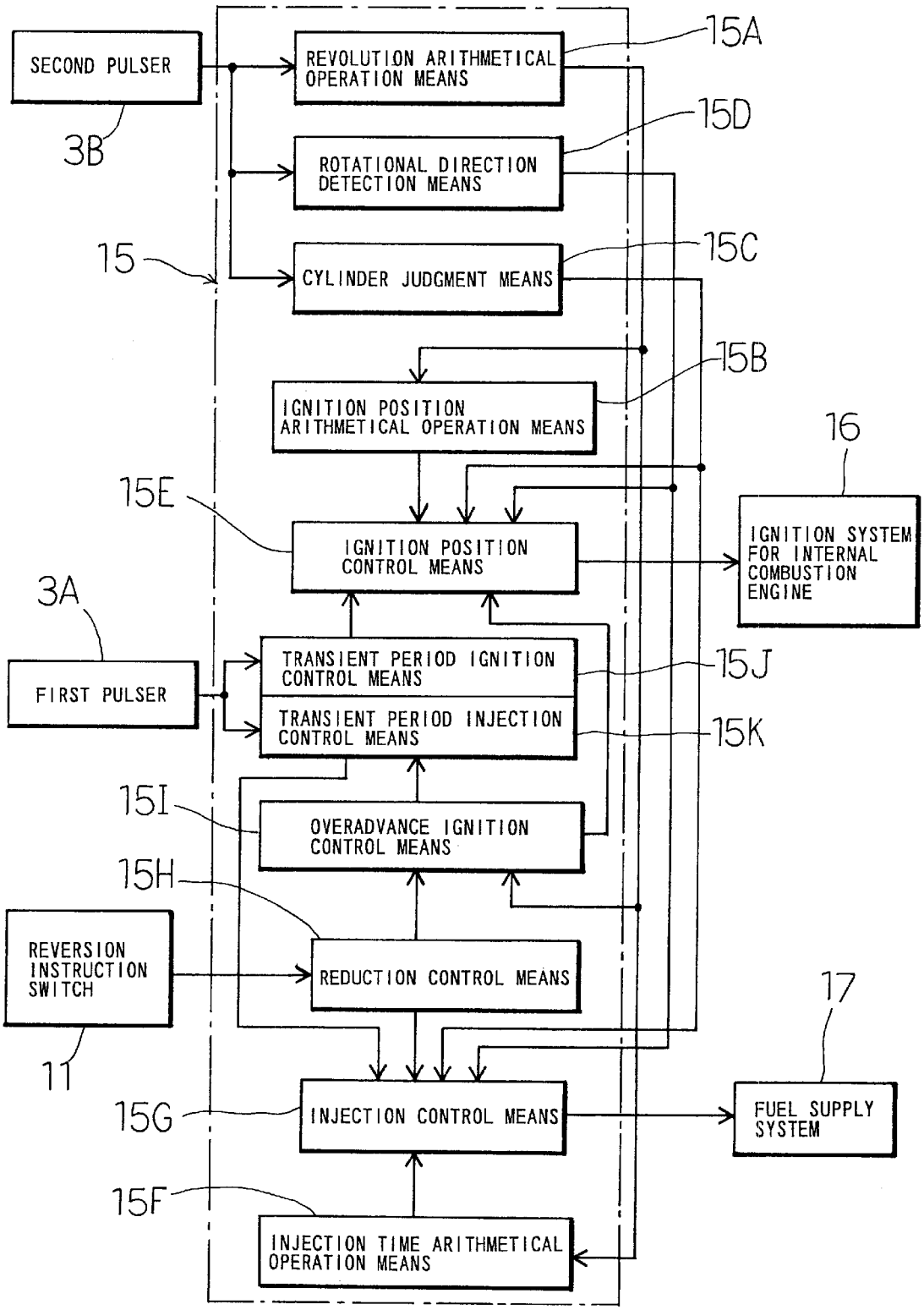
FIG. 2 is a block diagram of one embodiment of a control unit used for the control system of FIG. 1.

An embodiment of the electronic control unit 15 used for the invention is shown in FIG. 2. In the electronic control unit 15 of FIG. 2, revolution arithmetical operation means 15A serves to arithmetically operate a revolution of the engine from the generation distance (a time required for rotating the crank shaft of the engine at a predetermined angle) between the pulses generated by the second pulser 3B, the pulses Vp1 and Vp2, for example.

The revolution arithmetical operation means 15A may be so constructed as to arithmetically operate the revolution of the engine form the generation distance of the output pulses of the first pulser 3A (the generation distance between the pulses Vpa and Vpb, for example).

Ignition position arithmetical operation means 15B serves to arithmetically operate the ignition position of the engine in the revolution obtained by the revolution arithmetical operation means. The ignition position arithmetical operation means is so constructed as to arithmetically operate the ignition positions in the respective revolutions using a three-dimensional map for the ignition position arithmetically operating the ignition position which applies a relation of the revolution of the engine, the opening degree of the throttle valve supplied from a throttle sensor not shown and the ignition position.

The ignition positions of the respective cylinders are obtained in the form of a time (a counted value of clock pulses) which is required for rotating the engine from a reference position set for the respective cylinders (a position which is advanced by the angle of 72° relative the rotary angle position of the crank shaft when the pistons of the respective cylinders reach the top dead center) to the ignition positions of the respective cylinders.

Cylinder judgment means 15C judges the cylinder which should be ignited and the cylinder to which the fuel should be injected from the phase relation between the pair of pulses and the single pulse generated by the second pulser. For example, as shown in FIG. 5B, it recognizes the pulse Vp1 of positive polarity for the one indicating the low speed ignition position of the first cylinder when the second pulser 3B generates the pulse Vp1 after successively generating the two pulses Vn11 and Vn12 of negative polarity and recognizes the pulse Vp2 of positive polarity for the one indicating the low speed ignition position of the second cylinder when the second pulser 3B generates the pulse Vp2 following the single pulse Vn2 of negative polarity.

The cylinder judgment means 15C also recognizes the pulse Vn2 of negative polarity for the one indicating the reference position (the position of 72° before the top dead center of the second cylinder) where the measurement of the ignition position of the second cylinder starts when the pulse Vn2 is generated following the single pulse Vp1 indicating the low speed ignition position of the first cylinder and recognizes the pulse Vn11 of negative polarity for the one indicating the reference position (the position of 72° before the top dead center of the first cylinder) where the measurement of the ignition position of the first cylinder starts when the pulse Vn11 is generated following the pulse Vp2 indicating the low speed ignition position of the second cylinder.

Rotational direction detection means 15D detects the rotational direction of the internal combustion engine from the phase relation between the pair of pulses the single pulse generated by the second pulser 3B. More particularly, it detects that the engine rotates in the forward direction when the single pulse Vn1 is generated following the pair of pulses Vn11 and Vn12 as shown in FIG. 5B and that the engine rotates in the reverse direction when the pair of pulses Vp11 and Vp12 are generated following single pulse Vn1 as shown in FIG. 6B.

Ignition position control means 15E serves to control the engine to be ignited at the cylinder judged by the cylinder judgment means 15C in order to maintain the rotation of the engine in the rotational direction detected by the rotational direction detection means 15D. The ignition position control means 15E starts to measure the ignition position obtained by being arithmetically operated by the ignition position arithmetical operation means 15B when the reference signal Vn11 or Vn12 is generated at the position of 72° before the top dead center of the respective cylinders when the engine rotates in the forward direction and to ignite the respective cylinders by applying the ignition timing signal for the respective cylinders to the ignition system 16 for the internal combustion engine when the ignition position of the respective cylinders is measured. The ignition position control means 15E also ignites the first and second cylinders by applying the ignition timing signal for the respective cylinders to the ignition system 16 for the internal combustion engine when the instruction is applied from overadvance ignition control means 15J described later.

The ignition position control means 15E controls the engine to be ignited at the first cylinder when the first pulser 3A generates the low speed ignition position detection signal Vna in the condition of the rotation of the engine in the reverse direction and at the second cylinder when the first pulser 3A generates the low speed ignition position detection signal Vnb.

Injection time arithmetical operation means 15F serves to arithmetically operate the time for which the fuel is injected from the injector on the revolution arithmetically operated by the revolution arithmetical operation means 15A, the opening degree of the throttle valve detected by the throttle sensor not shown, the atmospheric pressure detected by the atmospheric pressure sensor, the temperature of the engine detected by the engine temperature sensor and so on.

The injection control means 15G controls the fuel supply system 17 to inject the fuel from the injector for the respective cylinders during the injection time obtained by being arithmetically operated by the injection time arithmetical operation means 15F by applying the injection instruction to the fuel supply system 17 at the injection timing suitable for maintaining the rotation of the engine in the rotational direction detected by the rotational direction detection means 15D. The injection control means 15G also controls the fuel supply system 17 to inject the fuel from the injector for the first cylinder and the injector for the second cylinder by applying the injection instruction for the first and second cylinders to the fuel supply system 17 when the injection instruction is applied from overadvance injection control means 15K.

Reduction control means 15H serves to reduce the revolution of the engine by interrupting the fuel supplied to the engine when the reversion instruction switch 11 generates the reversion instruction. The reduction control means 15H controls the fuel supply system 17 to stop the injection of the fuel from the injector of the fuel supply system 17 when the reversion instruction is applied and to again inject the fuel from the injector at the time slightly before the revolution of the engine reaches the overadvance starting revolution.

The time when the fuel from the injector is again injected is so appropriately set in accordance with the position of the injector so that the ratio of air to fuel of the mixture gas supplied into the cylinders of the engine when the ignition is made at the overadvanced position gets the value suitable for the combustion of the fuel. More particularly, in case that the injector is provided so as to inject the fuel directly into the cylinders of the engine, the fuel can be reinjected immediately before the revolution of the engine reaches the overadvance starting revolution (the timing for igniting the engine at the overadvanced position), but in case that the injector is provided in a mixture gas flow passage from the intake pipe to scavenging port of the engine, the fuel should be reinjected more early because it takes much time until the ratio of air to fuel of the mixture gas in the cylinder gets the value suitable for the ignition after the fuel is reinjected.

Overadvance ignition control 151 serves to ignite the engine only once at the overadvanced position of the first cylinder (the position of 52° before the top dead center of the first cylinder) when the revolution of the engine obtained by arithmetically operated by the revolution arithmetical operation means 15A is reduced to the overadvance starting revolution. This causes the piston of the engine to be forced back to drive the engine in the reverse direction.

Transient period ignition control means 15J serves to ignite the first and second cylinders by applying the ignition timing to the ignition system 16 for the internal combustion engine when the first pulser 3A detects the front edges of the first reluctors 601 and 602, respectively to generate the pulses Vna and Vnb during the transient period after the engine is ignited at the overadvanced position of the first cylinder until the rotational direction of the engine is confirmed by the rotational direction detection means 15D. In the illustrated embodiment, the ignition timing signals for the first and second cylinders are supplied by applying the instruction to the ignition position control means 15E when the pulses Vna and Vnb are generated, respectively.

Transient period injection control means 15K serves to inject the fuel from the injector for the first cylinder and the injector for the second cylinder at the positions where the low speed ignition position detection pulses Vna and Vnb are generated during the transient period after the engine is ignited at the overadvanced position of the first cylinder until the rotational direction of the engine is confirmed by the rotational direction detection means 15D. In the illustrated embodiment, the injection instruction is supplied from the injection control means 15G to the fuel supply system 17 by applying the instruction to the injection control means 15G when the pulses Vna and Vnb are generated, respectively.

The means 15A through 15K of the electronic control unit 15 can be accomplished by practicing a predetermined program by a microcomputer provided in the control unit 15.

In the aforementioned control system, with the reversion instruction applied by the reversion instruction switch 11, the reduction control means 15H interrupts the fuel supplied to the engine to reduce the revolution of the engine. When the revolution of the engine obtained by being arithmetically operated by the revolution arithmetical operation means 15A reaches the overadvance starting revolution or the inertia of the engine is fully smaller, the transient period ignition control means 151 controls the engine to be ignited only once at the overadvanced position of the first cylinder (the position of 52° before the top dead center of the first cylinder). Thus, the piston of the engine is forced back to drive the engine in the reverse direction.

During the transient period after the engine is ignited at the overadvanced position of the first cylinder until the rotational direction of the engine is confirmed, when the low speed ignition position detection pulses Vna and Vnb are generated, the transient period injection control means 15K applies the instruction to the injection control means 15G to inject the fuel from the injector for the first cylinder and the injector for the second cylinder at the position where the low speed ignition position detection pulses Vna and Vnb are generated, respectively. Also, during the transient period after the engine is ignited at the overadvanced position of the first cylinder until the rotational direction of the engine is confirmed, when the low speed ignition position detection pulses Vna and Vnb are generated, the transient period ignition control means 15J applies the instruction to the ignition control means 15E to ignite the first cylinder and the second cylinder at the positions where the pulses Vna and Vnb are generated, respectively.

Thereafter, when the rotational direction detection means 15D detects that the engine rotates in the reverse direction, the fuel is injected by the injection control means 15G at the position suitable for maintaining the reverse rotation of the engine and the ignition position control means 15E applies the ignition timing signal to the ignition system at the position suitable for maintaining the reverse rotation of the engine.

After the engine is ignited at the overadvanced position, when the rotational direction detection means 15D detects that the engine continues to rotate in the forward direction, the injection control means 15G injects the fuel and the ignition position control means 15E ignites the engine, respectively at the position suitable for maintaining the forward rotation of the engine.

As aforementioned, with the both ends of the reluctors 601 and 602 corresponding to the respective cylinders of the internal combustion engine as viewed in the peripheral direction set so as to be provided in both sides of the rotary angle position of the crank shaft corresponding to the top dead center of the piston of the corresponding cylinder of the engine so that the first pulser 3A generates the low speed ignition position detection pulses at the position suitable for the low speed ignition position of the corresponding cylinder of the engine in spite of the rotational direction of the engine, when the signal generator unit generates the low speed ignition position detection pulses Vna and Vnb for the corresponding cylinder, the respective cylinders are ignited. This enables the cylinders of the engine to be ignited at the position suitable for the low speed ignition position even though the reversion of the engine succeeds or fails in the transient condition after the engine is ignited at the overadvanced position. Thus, the engine can be prevented from stalling in the transient condition.

In the illustrated embodiment, the first reluctors 601 and 602 have such a configuration as symmetrically formed relative to the top dead center of the first cylinder and the top dead center of the second cylinder, relatively as shown in FIG. 4A, but they may be formed in a nonsymmetrical manner relative to the top dead center of the corresponding cylinder.

Figure 4B:
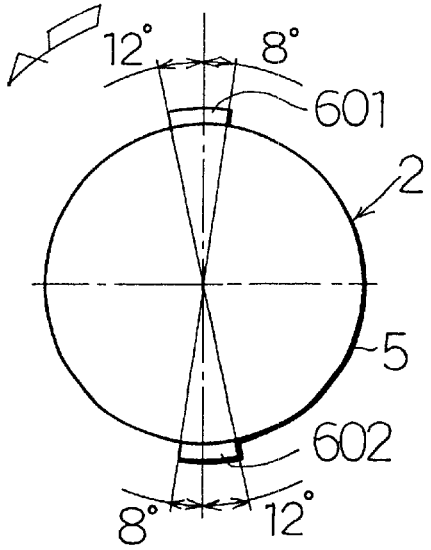

Since the speed should be desirably smaller in view of safety. To this end, as shown in FIG. 4B, both ends of the reluctors 601 and 602 positioned in the forward side as viewed from the rotational direction when the engine rotates in the forward direction may be located at the position advanced at the angle of 12° relative to the top dead center of the first cylinder and at the position delayed at the angle of 8° relative to the top dead center of the first cylinder, respectively. Thus, the when the engine rotates in the forward direction, the first pulser can generate the low speed ignition position detection signals at the position suitable for the low speed ignition position (the position of 12° before the top dead center, in the illustrated embodiment) and when the engine rotates in the reverse direction, the first pulser can generate the low speed ignition position detection signals at the position slightly delayed relative to the suitable low speed ignition position (the position of 8° before the top dead center, in this position). With the reluctors formed as aforementioned, since the ignition position can be delayed slightly relative to the most suitable ignition position (the position of 12° before the top dead center) for rotating the engine in the reverse direction during the transient period from the ignition of the engine at the overadvanced position to the confirmation of the rotational direction of the engine, the rotary speed of the engine in the reverse direction can be restrained from increasing.

Although some preferred embodiments of the invention have been described and illustrated with reference to the accompanying drawings, it will be understood by those skilled in the art that various changes and modifications may be made without departing from the spirit and scope of the invention as described herein justbelow.

Figure 8A:
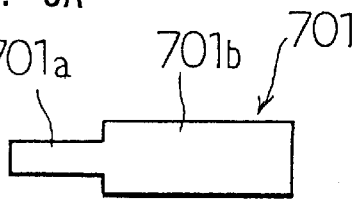
FIGS. 8A and 8B a re plane view s of the configurations of a two step reluctor and a one step reluctor which constitute the second reluctor.
Figure 8B:
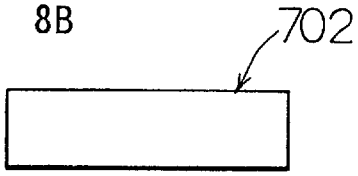
Figure 8C:
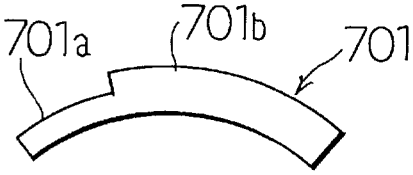
FIG. 8C is a plane view of a two step reluctor constructed in accordance with a modification of the invention.

Although, in the illustrated embodiment, the two step reluctor 701 of the rotor of the signal generator unit has such a configuration as have the first narrow portion 701*a* and the second wider portion 701*b* as shown in FIG. 8A, it is not limited to the aforementioned configuration and it may have the first portion 701*a* of smaller thickness and the second portion 701*b* of larger thickness as shown in FIG. 8C so that it has a change in thickness at the boundary of the first and second portions 701*a* and 701*b*.

Although, in the embodiment of FIG. 7, the reluctors may be formed of protrusion, they may have any configuration as long as it can abruptly change reluctance of the magnetic path through which the magnetic flux interlinking the signal coil of the pulsers flow. The modified reluctors are required to change the reluctance in one step or two steps in accordance with the one step or two step reluctors.

In the illustrated embodiment, the two cylinder two cycle internal combustion engine is controlled by the invention, the invention may be applied to a single cylinder two cycle internal combustion engine or three or more than cylinder two cycle internal combustion engine.

Although, in the illustrated embodiment, the revolution of the engine is reduced by stopping the fuel from being supplied to the engine when the reversion instruction is applied, the reduction of revolution can be accomplished by delaying the ignition position, thinning the mixture gas by reducing the supply amount of fuel, thickening the mixture gas by increasing the supply amount of fuel.

Although, in the illustrated embodiment, the fuel is supplied to the engine by using the injector, the invention can be applied to the engine having a carburetor for the fuel supply system. In case that the carburetor is used for the fuel supply system, the fuel can be interrupted to reduce the revolution of the engine by closing an electromagnetic valve provided in the fuel flow passage.

Although, in the illustrated embodiment, the revolution of the engine is reduced by interrupting the fuel supplied to the engine by the reduction control means 15G when the reversion instruction is applied, the reduction of the revolution of the engine may be accomplished by stalling the engine by stopping the operation of the ignition system for the internal combustion engine when the reversion instruction is applied.

It will be noted that since the control system of the invention enables the engine to be ignited at the position suitable for the low speed ignition position even though the reversion of the engine succeeds or fails in the transient condition after the engine is ignited at the overadvanced position, the engine can be effectively prevented from stalling in the transient condition.

Thus, it should be noted that the invention is defined only to the appended claims.

What is claimed is:

1. A control system for a two cycle internal combustion engine comprising reversion instruction generator means to generate a reversion instruction to instruct a rotational direction of said internal combustion engine and a control unit to control said internal combustion engine so as to accomplish a speed reduction step of reducing a revolution of said internal combustion engine when said reversion instruction is generated and an overadvanced ignition step of igniting said internal combustion engine at an overadvanced position for reversing the rotational direction of said internal combustion engine when a revolution of said internal combustion engine is reduced to an overadvance starting revolution at said speed reduction step, said control system further comprising signal generator means including a rotor mounted on a crank shaft of said engine and having n (n is an integral number of 1 or more than) reluctors provided so as to correspond to respective one of n cylinders in said engine with a thickness and a width of said reluctors uniform in a rotational direction of a crank shaft of said engine and pulsers disposed at positions where said reluctors of said rotor can be detected to generate low speed ignition position detection pulses for said respective cylinders when front edges of said reluctors corresponding to said respective cylinders as viewed in the rotational direction is detected, said reluctors corresponding to said respective cylinders being provided so that both peripheral ends of said reluctors are positioned in both sides of a linear line bonding a center of said crank shaft and a center of a magnetic pole of said pulsers when a piston of said cylinder of said internal combustion engine reaches the top dead center and said both peripheral ends of said reluctors being so set that said pulsers generate said low speed ignition position detection pulses at positions suitable for an ignition position for said cylinders in said internal combustion engine even though said engine rotates in either of rotational directions, and said control unit including transient period ignition control means to ignite said internal combustion engine at a position where said signal generator means detects said front edges of said reluctors corresponding to said respective cylinders to generate said low speed ignition position detection pulses after said overadvanced ignition step is performed.

2. A control system for a two cycle internal combustion engine comprising reversion instruction generator means to generate a reversion instruction to instruct a rotational direction of said internal combustion engine and a control unit to control said internal combustion engine so as to accomplish a speed reduction step of reducing a revolution of said internal combustion engine when said reversion instruction is generated and an overadvanced ignition step of igniting said internal combustion engine at an overadvanced position for reversing the rotational direction of said internal combustion engine when said revolution of said internal combustion engine is reduced to an overadvance starting revolution at said speed reduction step, said control system further comprising signal generator means including a rotor mounted on a crank shaft of said engine and having first and second inductor magnetic pole portions provided so as to be offset from each other in an axial direction of said crank shaft of said internal combustion engine and first and second pulsers provided corresponding to said first and second inductor magnetic pole portions, respectively, said first inductor magnetic pole portion having n (n is an integral number of 2 or more than) first reluctors formed with a thickness and a width uniform in the rotational direction of said crank shaft and disposed at an equal angular distance corresponding to n cylinders in said engine, said second inductor magnetic pole portion having n second reluctor including a two stepped reluctor portion of first and second portions arranged in the rotational direction of said crank shaft and formed so that a boundary of said first and second portions changes in their thickness and width and (n−+b 1) one step reluctor portions formed so as to have a thickness and a width uniform in the rotational direction of said crank shaft, said second reluctors being disposed at an equal angular distance with said two step reluctor portion corresponding to one of said cylinders of said internal combustion engine and with said (n−+b 1) one step reluctor portions corresponding to said cylinders other than said one of said cylinders, said first pulser being disposed so as to be able to detect each of said reluctors of said first inductor magnetic pole portions of said rotor to generate pulses of different polarities when both of said peripheral ends of said reluctors of said first inductor magnetic pole portion are detected, said second pulser being disposed so as to be able to detect said two step reluctor and said one step reluctors of said second inductor magnetic pole portion of said rotor to generate a pair of pulses of the same polarity, respectively when the end of said two step reluctor in the side of said first portion and said boundary are detected, a single pulse of polarity different from said polarity of said pair of pulses when the end of said two step reluctor in the side of said second portion is detected and pulses of different polarities, respectively when said both ends of said single stepped reluctor are detected, said first reluctors corresponding to said cylinders being so set that said first pulsers generate pulses at a position suitable for a low speed ignition position for said cylinder in said internal combustion engine when said first pulsers detect said front edges of said first reluctors corresponding to said cylinders in the rotational direction even though said engine rotates in either of rotational directions, and said control unit comprising transient period ignition control means to ignite said internal combustion engine when said front edges of said first reluctors in the rotational direction is detected after said overadvanced ignition step is performed, rotational direction detection means to detect said rotational direction of said internal combustion engine on a phase relation between said pair of pulses and said single pulse generated by said second pulser, revolution arithmetical operation means to arithmetically operate a revolution of said internal combustion engine on a generation distance of said pulses generated by said first pulser or on a generation distance of said pulses by said second pulser, ignition position arithmetical operation means to arithmetically operate an ignition position of said internal combustion engine at said revolution arithmetically operated by said revolution arithmetical operation means, cylinder judgment means to judge which of said cylinders should be ignited on a phase relation between said pair of pulses and said single pulse generated by said second pulser and ignition position control means to control said cylinder judged by said cylinder judgment means to be ignited at said ignition position arithmetically operated by said ignition position arithmetical operation means so as to maintain the rotation of said internal combustion engine in said rotational direction detected by said rotational direction detection means.

* * * * *

UNITED STATES PATENT AND TRADEMARK OFFICE

CERTIFICATE OF CORRECTION

PATENT NO. : 6,405,687 B1
DATED : June 18, 2002
INVENTOR(S) : Arakawa et al.

It is certified that error appears in the above-identified patent and that said Letters Patent is hereby corrected as shown below:

Title page,
Item [56], References Cited, FOREIGN PATENT DOCUMENTS, please add the following Foreign References:

-- 11-82270 Japan
9-252378 Japan
11-93719 Japan --

Column 4,
Lines 53 and 58, delete "(n-+b 1)" and insert -- (n-1) --.

Column 6,
Line 38, delete "a re plane view s" and insert -- are plane views --.

Column 17,
Lines 50 and 56, delete "(n-+b 1)" and insert -- (n-1) --.

Signed and Sealed this

Twenty-sixth Day of November, 2002

*Attest:*

*Attesting Officer*

JAMES E. ROGAN
*Director of the United States Patent and Trademark Office*